US006484364B2

(12) United States Patent
Turner

(10) Patent No.: US 6,484,364 B2
(45) Date of Patent: Nov. 26, 2002

(54) LIFTING ASSEMBLY

(75) Inventor: William E. Turner, Kirkwood, NY (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 09/837,883

(22) Filed: Apr. 18, 2001

(65) Prior Publication Data

US 2002/0059697 A1 May 23, 2002

Related U.S. Application Data

(60) Provisional application No. 60/198,408, filed on Apr. 19, 2000.

(51) Int. Cl.[7] ..... A45C 3/00; A45C 13/26

(52) U.S. Cl. ..... 16/443; 16/444; 16/405; 16/429; 312/223.2

(58) Field of Search ..... 16/443, 444, 416, 16/405, 429; 190/115, 39; 74/543, 544, 546, 547, 551.3; 294/27.1, 57; 220/761–764; 361/724–727, 759, 796; 312/223.2, 244

(56) References Cited

U.S. PATENT DOCUMENTS

| | | | | | |
|---|---|---|---|---|---|
| 2,453,835 | A | * | 11/1948 | Donkin | 16/429 |
| 3,167,808 | A | * | 2/1965 | Lindenberg et al. | 16/444 |
| 3,988,802 | A | * | 11/1976 | Bruni et al. | 16/405 |
| 4,374,188 | A | * | 2/1983 | Campbell et al. | 16/444 |
| 4,727,620 | A | * | 3/1988 | Gummelt | 16/429 |
| 4,895,231 | A | * | 1/1990 | Yamaguchi et al. | 16/444 |
| 4,970,625 | A | * | 11/1990 | Belanger et al. | 174/35 R |
| 5,011,198 | A | * | 4/1991 | Gruenberg et al. | 190/115 |
| 5,075,926 | A | * | 12/1991 | Jeong | 16/429 |
| 5,131,708 | A | | 7/1992 | Denzin | 294/168 |
| 5,279,443 | A | | 1/1994 | Koda et al. | 220/769 |
| 5,317,795 | A | * | 6/1994 | Bolton et al. | 16/429 |
| 5,845,978 | A | * | 12/1998 | Jung | 16/405 |
| 5,961,194 | A | * | 10/1999 | Shaw | 16/412 |

FOREIGN PATENT DOCUMENTS

| | | | |
|---|---|---|---|
| CH | 649 054 A5 | 4/1985 | B65D/1/10 |
| DE | 87 09 739.7 | 8/1988 | H05K/5/02 |
| EP | 0 869 071 A2 | 10/1998 | B65B/25/28 |

* cited by examiner

*Primary Examiner*—Chuck Y. Mah
(74) *Attorney, Agent, or Firm*—Baker Botts L.L.P.

(57) ABSTRACT

A lifting assembly for a chassis having structural members wherein the lifting assembly comprises a first lift handle sub-assembly and a second lift handle sub-assembly. Each lift handle sub-assembly includes a first lifting bracket slidably mounted to a first chassis structural member and a second lifting bracket slidably mounted to a second chassis structural member positioned from the first lifting bracket. A lift handle is attached at each end thereof to one end of the first and second lifting brackets. Attached to a second end of the first and second lifting brackets is a lower stop bar sliding within the chassis structural-members. Attached to the chassis structural members in the path of movement of the lower stop bar is a slide stop bar that establishes the limit of movement of the lift handle to a gripping position.

13 Claims, 5 Drawing Sheets

FIG. 4
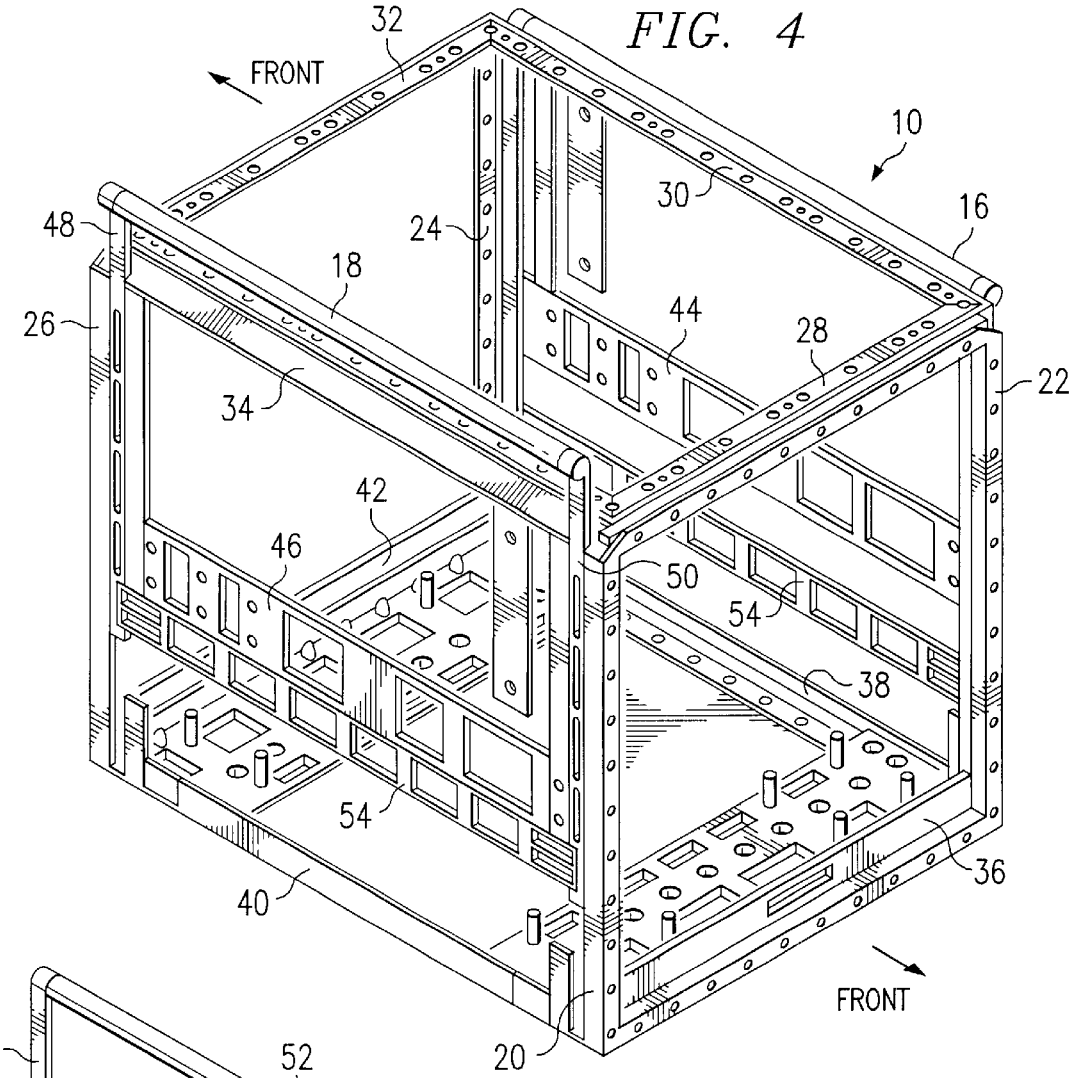
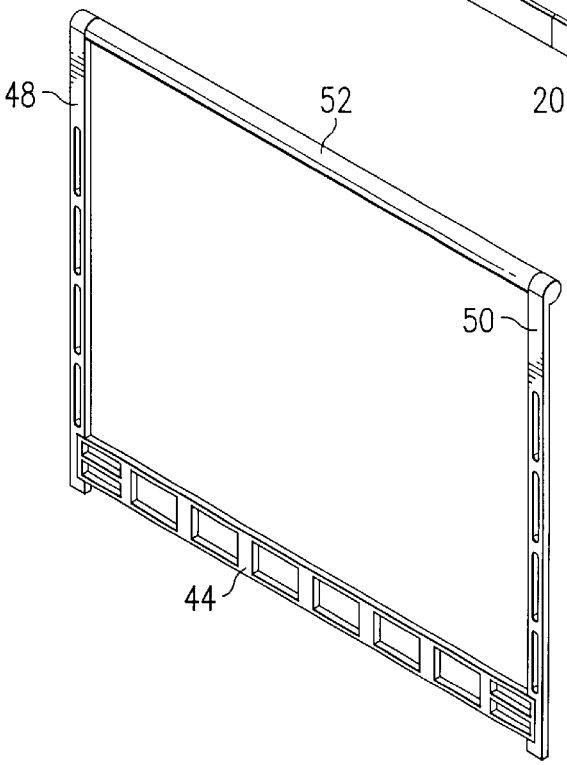
FIG. 6

LIFTING ASSEMBLY

RELATED APPLICATION

This application claims the benefit of U.S. provisional application Serial No. 60/198,408, filed Apr. 19, 2000, entitled Lifting Assembly.

TECHNICAL FIELD OF THE INVENTION

This invention. relates to a lifting assembly and, more particularly, a low-profile lifting assembly retractable within a chassis structure.

BACKGROUND OF THE INVENTION

Presently available commercial and military handle lifting assemblies are large and bulky and not suitable for use in an environment that requires a small footprint and retractable within a chassis structure. In addition, existing lifting assemblies are unnecessarily complex and expensive to manufacture and many designs expose a user to hand injury. In addition, available lifting assemblies are not designed for comfortable use with non-slip grip features.

SUMMARY OF THE INVENTION

The present invention comprises a lifting assembly having first and second lift handles, each retractably mounted within structural members of a chassis to distribute weight to the chassis structure. Each lift handle comprises a first lifting bracket slidably mounted within and to a chassis structural member and a second lifting bracket also slidably mounted within and to a chassis structural member in a position displaced from the first lifting bracket. Attached to one end of the first and second lifting brackets is a lifting bar, wherein the lifting bar is attached on each end thereof to one end of the first and second lifting brackets. A lower stop bar is attached at each end thereof to a second end of the first and second lifting brackets, the lower stop bar is slidable within the structural members with movement of the first and second lifting brackets. Attached to the chassis structural members is a slide stop bar. The slide stop bar is positioned in the path of movement of the lower stop bar to limit displacement thereof and thereby establish a gripping position for the lifting bar.

Further in accordance with the present invention, the first and second lifting brackets, the lower stop bar and the slide stop bar are mounted within the chassis to maintain EMI/RFI integrity for utilization of the chassis to support radio equipment.

Further in accordance with the present invention, the lifting assembly provides the technical advantage of distributing weight along chassis structural members, hereby minimizing concentration of lifting forces.

Further, the lifting assembly provides the advantage of a low profile, simplicity in structural members, and assembly into a chassis.

Other technical advantages will be readily apparent to one skilled in the art from the following figures, description, and claims.

BRIEF DESCRIPTION OF THE DRAWINGS

For a more complete understanding of the present invention and the advantages thereof, reference is now made to the following description taken in connection with the accompanying drawings.

FIG. 4 is an isometric drawing illustrating the chassis of FIG. 1 with the top, each end and the sides removed to further illustrate the chassis structure with the lifting assembly mounted thereto;

FIG. 6 is an isometric drawing illustrating one of the two lift handles of the lifting assembly of FIG. 5.

DETAILED DESCRIPTION OF THE INVENTION

Figure 1:
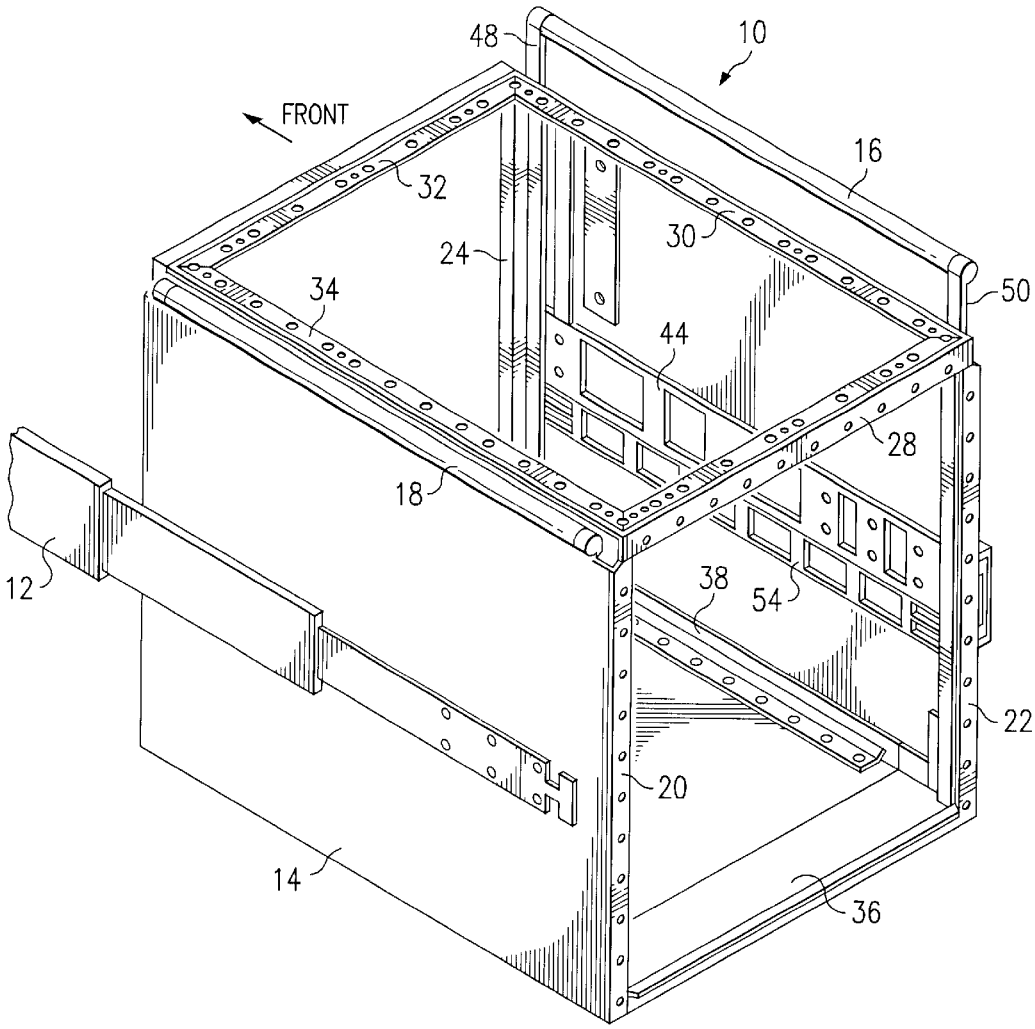
FIG. 1 is an isometric drawing illustrating a chassis for radio equipment with the lifting assembly of the present invention installed on opposite sides of the chassis with one of the two lift handles shown extended into a lifting position.
Figure 2:
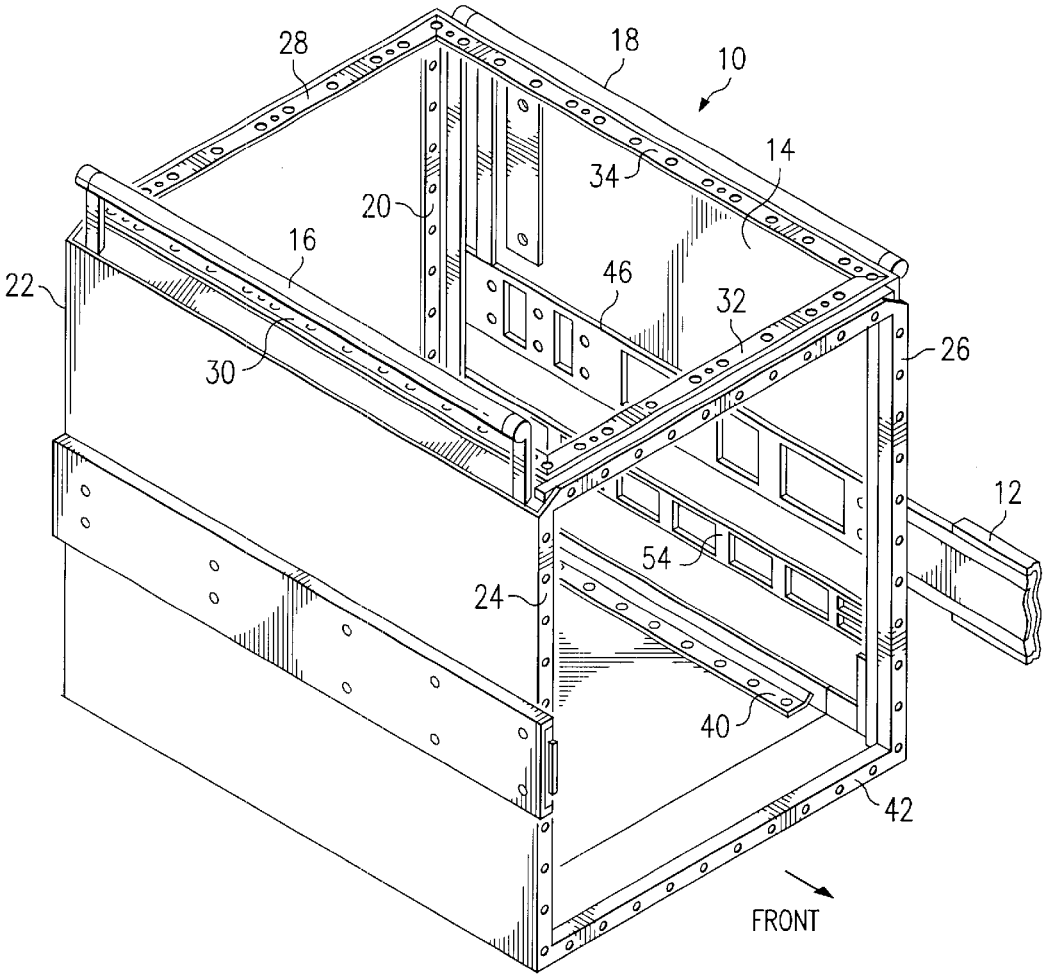
FIG. 2 is an isometric drawing of the chassis of FIG. 1 rotated 180° and illustrating one of the lifting bars of the lifting assembly of the present invention in a stowed position.
Figure 3:
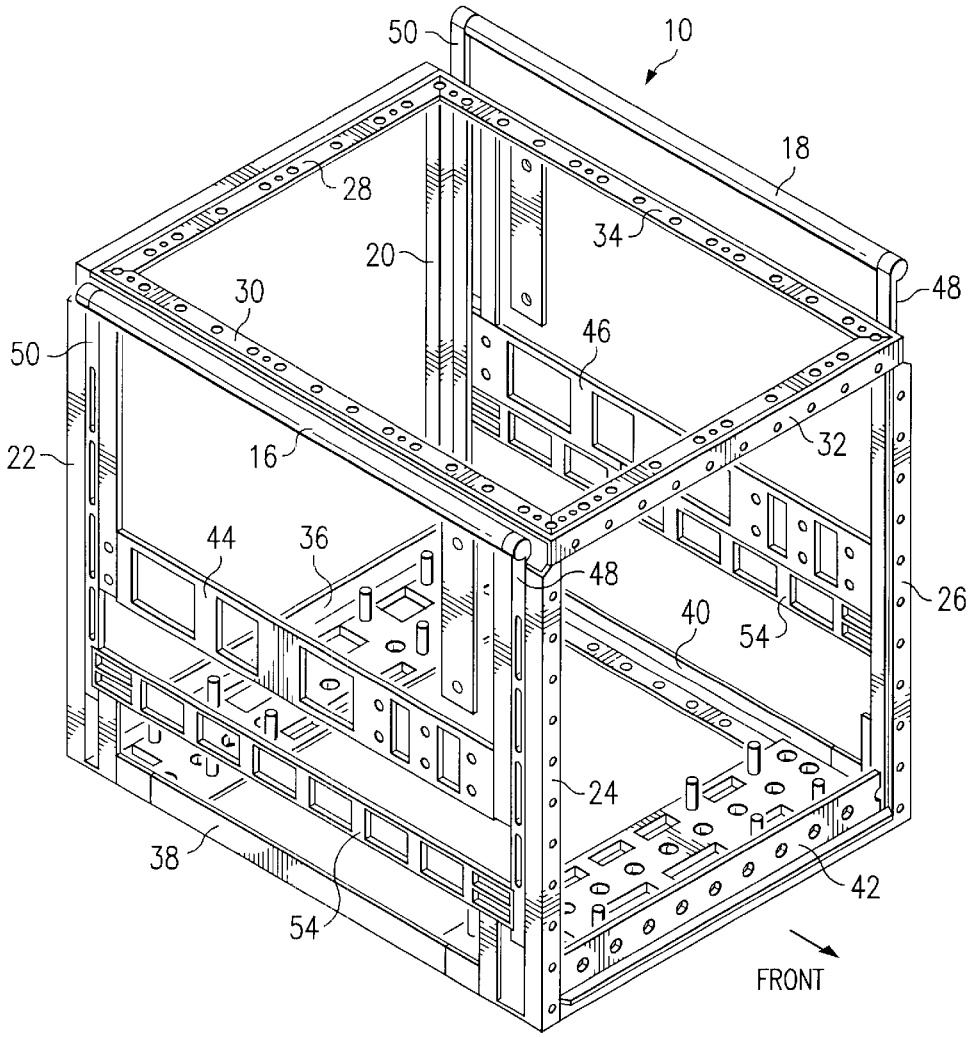
FIG. 3 is an isometric drawing illustrating the chassis of FIG. 1 rotated 180° with the top, each end and sides of the chassis removed to illustrate details of the lifting assembly of the present invention.

Referring to the FIGURES, there is illustrated a chassis 10 for supporting radio equipment or other electronic or non-electronic hardware. That chassis 10 is retractably mounted on a slide assembly 12 attached to a side panel 14 of the chassis. The top and each end cover of the chassis 10 have been removed for clarity in describing the lifting assembly of the present invention.

As illustrated, the lifting assembly includes a first lift handle 16, shown in an extended lifting position, and a second lift handle 18 shown retracted into a storage position. The chassis 10 includes vertical structural members 20, 22, 24 and 26, top horizontal structural members 28, 30, 32 and 34, along with bottom structural members 36, 38, 40 and 42 all assembled into the chassis 10.

As illustrated in FIG. 1 and FIGS. 3–7, attached to vertical structural members 22 and 24 is a slide stop bar 44 and attached to vertical structural members 20 and 26 is a slide stop bar 46.

As best illustrated in FIGS. 4, 5, 6 and 7, the lift handle 16 and the lift handle 18 are coupled to a first lifting bracket 48 and a second lifting bracket 50. Attached to one end of the first lifting bracket 48 and to one end of the second lifting bracket 50 is the lifting handle 16 or 18. The lift handle 16 and the lift handle 18 are sleeved with silicone rubber for an improved gripping surface and to minimize slippage in the hands of a user of the assembly.

Attached to a second end of the first lifting bracket 48 and the second lifting bracket 50 is a lower stop bar 54.

Figure 5:
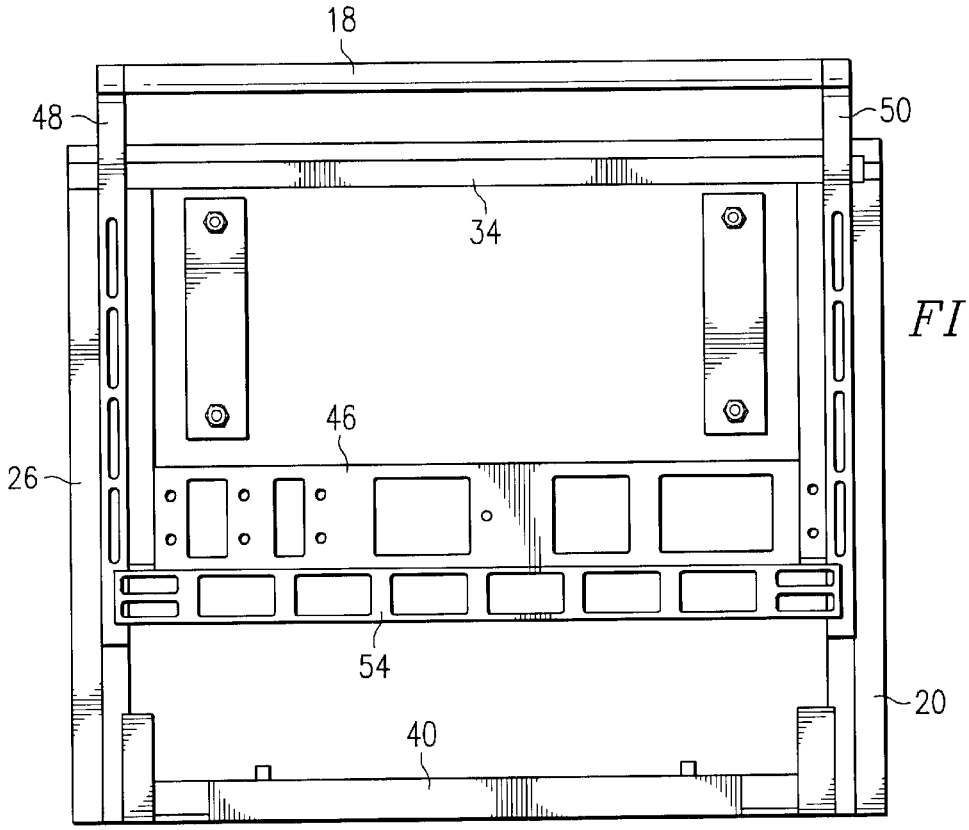
FIG. 5 is a side view of the chassis of FIG. 4 illustrating the assembly of elements of one of the lift handles of the lifting assembly of the present invention.
Figure 7:
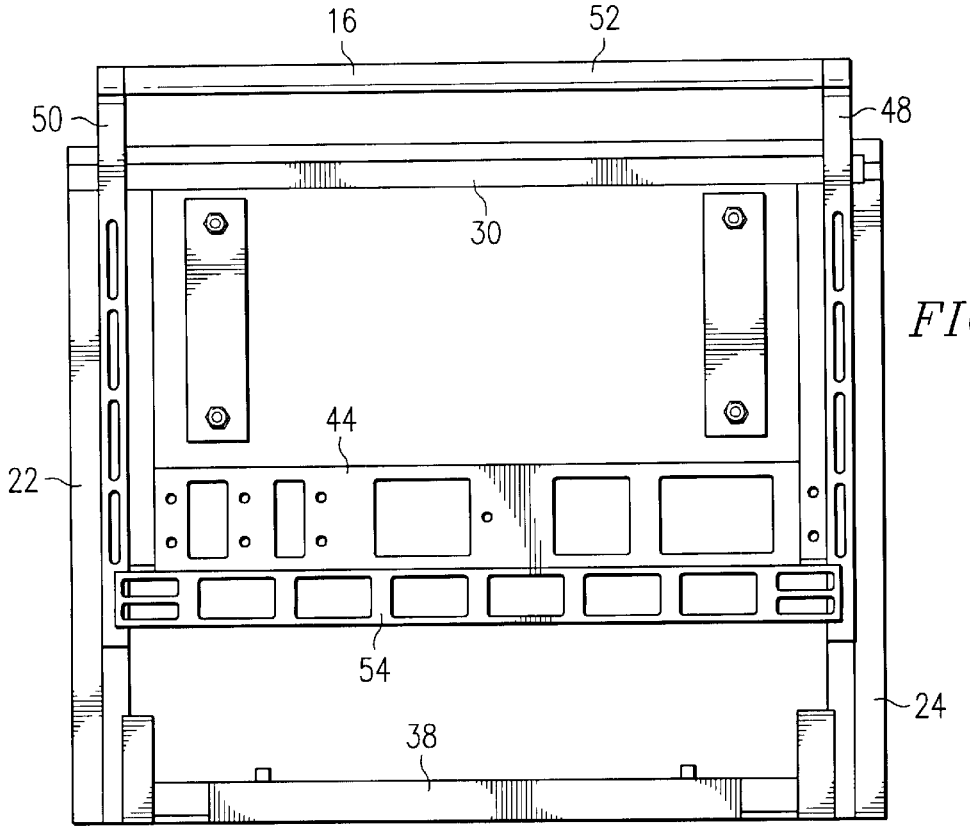
FIG. 7 is a side view of the chassis of FIG. 5 illustrating the interaction of one of the lift handles with a slide stop bar attached to chassis structural members.

As best illustrated in FIGS. 4 and 5, the first lifting bracket 48 and the second lifting bracket 50 are slidably mounted to vertical structural members behind the cover 14 as illustrated in FIG. 1. As such, the first lifting bracket 48 and the second lifting bracket 50 are fully captive within the chassis frame. Also, as best illustrated in FIGS. 1, 2, 3, 4, 5 and 7, the lower lift bar 54 moves from a stowed position to a lifting position. When in a lifting position, the lower stop bar 54 contacts the slide stop bar 44 or 46 along the length thereof. This lengthwise contact distributes the weight of the chassis 10 when carried by the lift handles 16 and 18.

As illustrated and described, the various parts of the lift handle 16 and the lift handle 18 are the same, allowing simplicity and cost-effective manufacture. Because the first lifting bracket 48 and the second lifting bracket 50 are confined within the chassis structure, EMI/RFI integrity is maintained. With both lift handles 16 and 18 in a retracted or stowed position, there is substantially no protrusion outside the chassis envelope, thereby enabling the chassis to fit within a smaller confinement. In addition, since the first lifting bracket 48 and the second lifting bracket 50 are slidably mounted to vertical structural members, the weight of the chassis, when lifted, is placed along the strongest structural members on each side of the chassis 10.

Although the invention and the advantages thereof have been described in detail for a preferred embodiment, it should be understand that various changes, substitutions and alterations are possible without departing from the scope of the invention as defined by the appended claims and equivalents thereof.

What is claimed is:

1. A lift assembly retractably mounted within a chassis, comprising:

a chassis having first and second structural members;

a first lifting bracket slidably mounted to the first structural member;

a second lifting bracket slidably mounted to the second structural member;

a lift handle attached to the first and second lifting brackets;

a lower stop bar attached to the first and second lifting brackets, the lower stop bar slidable within the chassis along with the first lifting bracket and the second lifting bracket, and a slide stop bar attached to the first and second structural members in a path of movement of the lower stop bar to limit movement thereof and thereby limit movement of the lift handle to a gripping position outside the chassis.

2. The lift handle as in claim 1, further comprising:

a coating covering the lift handle to improve the gripping surface thereof.

3. A lifting assembly comprising first and second lift handle sub-assemblies, each retractably mounted on opposite sides of and within a chassis, each lift handle sub-assembly comprising:

first and second chassis structural members;

a first lifting bracket slidably mounted to the first structural member;

a second lifting bracket slidably mounted to the second structural member;

a lift handle attached to the first and second lifting brackets;

a lower stop bar attached to the first and second lifting brackets, the lower stop bar slidable within the chassis along with the first lifting bracket and the second lifting bracket; and a slide stop bar attached to the first and second structural members in a path of movement of the lower stop bar to limit movement thereof and thereby limit movement of the lift handle to a gripping position outside the chassis.

4. The lifting assembly as in claim 3, wherein each lift handle sub-assembly further comprises:

a coating covering the lift handle to improve the gripping surface thereof.

5. A lift assembly retractably mounted within a chassis, comprising:

a chassis having a first structural member, a second structural member, a third structural member, and a fourth structural member;

a first lifting bracket slidably mounted to the first structural member;

a second lifting bracket slidably mounted to the second structural member;

a first lift handle attached to the first and second lifting brackets;

a first lower stop bar attached to the first and second lifting brackets, the first lower stop bar slidable within the chassis along with the first lifting bracket and the second lifting bracket;

a first slide stop bar attached to the first and second structural members in the path of movement of the first lower stop bar to limit movement thereof and thereby limit movement of the first lift handle to a gripping position outside the chassis;

a third lifting bracket slidably mounted to the third structural member;

a fourth lifting bracket slidably mounted to the fourth structural member;

a second lift handle attached to the third and fourth lifting brackets;

a second lower stop bar attached to the third and fourth lifting brackets, the second lower stop bar slidable within the chassis along with the third lifting bracket and the fourth lifting bracket; and a second slide stop bar attached to the third and fourth structural members in a path of movement of the second lower stop bar to limit movement thereof and thereby limit movement of the second lift handle to a gripping position outside the chassis.

6. The lifting assembly as in claim 5 wherein the chassis further comprises a first recess for accepting the first lift handle when in a retracted position and a second recess for accepting the second lift handle when in a retracted position.

7. The lifting assembly as in claim 5 wherein the first lifting bracket, the second lifting bracket, the third lifting bracket, and the fourth lifting bracket are confined within the chassis, thereby maintaining EMI/RFI integrity.

8. A lifting assembly comprising first and second lift handle sub-assemblies, each retractably mounted on opposite sides of and within a chassis, each lift handle sub-assembly comprising:

first and second chassis structural members;

a first lifting bracket slidably mounted to the first chassis structural member within the chassis;

a second lifting bracket slidably mounted to the second chassis structural member within the chassis;

a lift handle attached to the first and second lifting brackets;

a lower stop bar attached to the first and second lifting brackets, the lower stop bar slidable within the chassis along with the first lifting bracket and the second lifting bracket; and a slide stop bar attached to the first and second chassis structural members along one side of the chassis and in a path of movement of the lower stop bar to engage the lower stop bar to distribute the weight of the chassis along the slide stop bar and to limit movement of the lower stop bar and thereby limit movement of the lift handle to a gripping position outside of the chassis.

9. The lifting assembly as in claim 8 wherein the chassis comprises a first recess for accepting the first lift handle when in a retracted position and a second recess for accepting the second lift handle when in a retracted position.

10. The lifting assembly as in claim 8 wherein the first lifting bracket and the second lifting bracket of each lift handle sub-assembly are confined within the chassis, thereby maintaining EMI/RFI integrity.

11. A lift assembly retractably mounted in a chassis to chassis structural members, comprising:

a first lifting bracket slidably mounted within the chassis to a first chassis structural member;

a second lifting bracket slidably mounted within the chassis to a second chassis structural member;

a lift handle attached to the first and second lifting brackets;

a lower stop bar attached to the first and second lifting brackets, the lower stop bar slidable within the chassis along with the first lifting bracket and the second lifting bracket;

a slide stop bar mounted within the chassis and attached to the chassis structural members in a path of movement of the lower stop bar to engage the lower stop bar and limit movement thereof and thereby limit movement of the lift handle to a gripping position outside the chassis structural members; and a side panel attached to the first chassis structural member and the second chassis structural member to enclose the first lifting bracket, the second lifting bracket, the lower stop bar and the slide stop bar within the chassis.

12. The lifting assembly as in claim 11 wherein the chassis further comprises a recess for accepting the lift handle when in a retracted position.

13. The lifting assembly as in claim 11 wherein the first lifting bracket, the second lifting bracket, the lower stop bar, and the slide stop bar are confined within the chassis, thereby maintaining EMI/RFI integrity.

* * * * *